US009236013B2

(12) United States Patent
Matsui

(10) Patent No.: US 9,236,013 B2
(45) Date of Patent: Jan. 12, 2016

(54) DISPLAY DEVICE FOR DETECTING DETERIORATION BASED ON DETECTED TEMPERATURE AND BACKLIGHT LUMINESCENCE

(75) Inventor: Katsuyuki Matsui, Tokyo (JP)

(73) Assignee: NEC DISPLAY SOLUTIONS, LTD, Tokyo (JP)

( * ) Notice: Subject to any disclaimer, the term of this patent is extended or adjusted under 35 U.S.C. 154(b) by 24 days.

(21) Appl. No.: 14/347,610

(22) PCT Filed: Sep. 29, 2011

(86) PCT No.: PCT/JP2011/072368

§ 371 (c)(1),
(2), (4) Date: Mar. 26, 2014

(87) PCT Pub. No.: WO2013/046392

PCT Pub. Date: Apr. 4, 2013

(65) Prior Publication Data

US 2014/0240377 A1 Aug. 28, 2014

(51) Int. Cl.

| | |
|---|---|
| ***G09G 3/36*** | (2006.01) |
| ***G09G 3/34*** | (2006.01) |
| ***G09G 3/00*** | (2006.01) |

(52) U.S. Cl.

CPC ..... *G09G 3/3406* (2013.01); *G09G 3/006* (2013.01); *G09G 3/3413* (2013.01); *G09G 3/36* (2013.01);

(Continued)

(58) Field of Classification Search

CPC .. G09G 3/3406; G09G 3/2003; G09G 3/3607
USPC ..... 345/690, 89, 102
See application file for complete search history.

(56) References Cited

U.S. PATENT DOCUMENTS

2008/0151144 A1* 6/2008 Hirose et al. ..... 349/69
2008/0246927 A1* 10/2008 Inoue et al. ..... 353/85

(Continued)

FOREIGN PATENT DOCUMENTS

| | | | |
|---|---|---|---|
| JP | 11-305195 | A | 11/1999 |
| JP | 3559161 | B2 | 8/2004 |
| JP | 2005-331644 | A | 2/2005 |
| JP | 2009-093098 | A | 4/2009 |
| JP | 2010-96943 | A | 4/2010 |

OTHER PUBLICATIONS

International Search Report in PCT/JP2011/072368 dated Dec. 27, 2011 (English Translation Thereof).

*Primary Examiner* — Long D Pham
(74) *Attorney, Agent, or Firm* — McGinn IP Law Group, PLLC

(57) ABSTRACT

A reference luminescence amount-acquiring unit of a display device obtains reference brightness corresponding to a BL drive value detected by a drive value-detecting unit and a temperature detected by a temperature-detecting unit. A deterioration-detecting unit calculates an initial status value based on a ratio of reference brightness obtained based on a temperature and a BL drive value in an initial status and brightness in the initial status detected by a luminescence amount-detecting unit, and stores the initial status value. The deterioration-detecting unit further calculates a current status value based on a ratio of reference brightness obtained based on a current temperature and a current BL drive value and current brightness detected by the luminescence amount-detecting unit, compares the initial status value with the current status value, and determines whether calibration is required. When calibration is determined to be required, a warning screen display unit causes performance deterioration to be displayed on a display unit.

4 Claims, 4 Drawing Sheets

(52) U.S. Cl.

CPC ..... *G09G 2320/0233* (2013.01); *G09G 2320/0666* (2013.01); *G09G 2320/0693* (2013.01); *G09G 2330/12* (2013.01); *G09G 2360/145* (2013.01); *G09G 2360/16* (2013.01); *G09G 2380/08* (2013.01)

(56) References Cited

U.S. PATENT DOCUMENTS

| | | | | |
|---|---|---|---|---|
| 2010/0141669 | A1* | 6/2010 | Sadahiro | 345/589 |
| 2011/0109655 | A1* | 5/2011 | Takeda | 345/690 |

* cited by examiner

PRIOR ART

DISPLAY DEVICE FOR DETECTING DETERIORATION BASED ON DETECTED TEMPERATURE AND BACKLIGHT LUMINESCENCE

TECHNICAL FIELD

The present invention relates to a deterioration-detecting circuit, a display device, and a performance deterioration-detecting method.

BACKGROUND ART

In display devices for graphic design use or medical use, regular calibration (CAL) is performed to correct display characteristic deterioration.

FIG. 4 is a diagram illustrating a configuration of a display device according to a related art. A display device includes a display unit using a display panel such as a liquid crystal display (LCD) or a projector (PJ). A warning screen-rendering circuit causes a video signal input from a personal computer or a video to be displayed on the display unit without change when calibration is unnecessary. A timer circuit detects an operating time of the display device or the number of days that have elapsed since calibration was previously performed, and outputs a warning output instruction to the warning screen-rendering circuit when the operating time or the number of days that have elapsed exceeds a reference value. When the warning output instruction is input from the timer circuit, the warning screen-rendering circuit determines that display characteristics have deteriorated, and causes a warning screen to be displayed on the display unit. Thus, the display device displays the warning screen, and recommends calibration to a user.

Meanwhile, Patent Document 1 discloses an LCD device that displays a message representing that it is necessary to exchange a lamp to a user when deterioration in brightness of a backlight (hereinafter referred to as a "BL") is detected. Further, Patent Document 2 displays an LCD display device that gives an instruction for exchanging a BL lamp to a user based on a comparison between a BL drive value at the beginning of use and a BL drive value after a certain period of time elapses.

DOCUMENTS OF THE PRIOR ART

Patent Document

[Patent Document 1]
Japanese Unexamined Patent Application First Publication No. 2009-93098
[Patent Document 2]
Japanese Patent No. 3559161

DISCLOSURE OF INVENTION

Problem to be Solved by the Invention

Display devices have a general characteristic in which deterioration progresses quickly in an environment of high ambient temperature and high brightness even when an operating time is the same. In this regard, a timer reference value according to a condition in which deterioration progresses most quickly is set to the timer circuit of the display device according to the related art illustrated in FIG. 4. For this reason, in ordinary use in which an ambient temperature and brightness are low, it takes longer than a timer reference value until a display characteristic deteriorates so severely that calibration is required. In other words, in ordinary use, a calibration frequency is likely to be reduced.

Further, since calibration is complicated, users desire to extremely reduce an execution frequency.

In order to reduce the execution frequency of the calibration while maintaining display reliability, it is necessary to detect a deterioration amount of display characteristics with a higher degree of accuracy than in the timer method of the related art. Although a display device is used at different display brightness and ambient temperatures, when a deterioration status is the same, it is desirable for a deterioration detection value used when the deterioration amount of display characteristics is detected to be the same value. Thus, as in the timer method of the related art, when the deterioration detection value becomes a certain value, the display device can determine that calibration is required.

However, in many display devices for graphic design use or medical use, brightness stabilization and temperature drift correction are performed, and performance is maintained even when a temperature or brightness changes. As described above, when brightness stabilization and temperature drift correction are performed, there is a problem in that it is difficult to detect display characteristic deterioration necessary to reduce a calibration frequency.

For example, in the technique disclosed in Patent Document 1, detected brightness is used as a deterioration value, but brightness does not change while brightness stabilization is being performed. However, when brightness stabilization is not performed, brightness significantly changes according to an ambient temperature, a warm-up status of the display device, or a user setting. In other words, the brightness value is inappropriate as a deterioration index.

Further, in the technique disclosed in Patent Document 2, the BL drive value used for display characteristic deterioration detection changes by temporal deterioration even in a brightness-stabilized state, but the detection value is significantly influenced by an ambient temperature or brightness set by the user. In other words, the BL drive value is inappropriate as a deterioration index.

As described above, a change in the display brightness or the BL drive value is a general display characteristic deterioration index, but when brightness stabilization and temperature drift correction are performed, it is difficult to use it for display characteristic deterioration detection.

The present invention was made in light of the foregoing, and it is desirable to provide a deterioration-detecting circuit, a display device, and a performance deterioration-detecting method, which are capable of detecting display characteristic deterioration needing calibration regardless of a use status.

Means for Solving the Problem

[1] The present invention provides a deterioration-detecting circuit of a display device configured to include a display panel, a light source configured to illuminate the display panel, and a control unit configured to control a luminescence amount of the light source, including: a luminescence amount-detecting unit configured to detect a luminescence amount of the light source or the display panel; a drive value-detecting unit configured to detect a drive value that is used to control the luminescence amount of the light source by the control unit; a temperature-detecting unit configured to detect an internal temperature or external temperature of the display device; a reference luminescence amount-acquiring unit configured to obtain a reference luminescence amount corresponding to the temperature detected by the temperature-detecting unit and the drive value detected by the drive value-detecting unit based on a relationship between the reference luminescence amount and the temperature of the light source and the drive value which are obtained previously; and a deterioration-detecting unit configured to obtain an initial status value based on a ratio of the reference luminescence amount obtained based on the temperature and the drive value in an initial status by the reference luminescence amount-acquiring unit and the luminescence amount in the initial status detected by the luminescence amount-detecting unit, obtain a current status value based on a ratio of the reference luminescence amount obtained based on a current temperature and a current drive value by the reference luminescence amount-acquiring unit and a current luminescence amount detected by the luminescence amount-detecting unit, compare the initial status value with the current status value, and give an instruction to display deterioration of the display device or the light source when calibration is determined to be required.

[2] Further, the present invention provides a display device which includes a display panel; a light source configured to illuminate the display panel; a control unit configured to control a luminescence amount of the light source; a luminescence amount-detecting unit configured to detect a luminescence amount of the light source or the display panel; a drive value-detecting unit configured to detect a drive value that is used to control the luminescence amount of the light source by the control unit; a temperature-detecting unit configured to detect an internal temperature or external temperature of the display device; a reference luminescence amount-acquiring unit configured to obtain a reference luminescence amount corresponding to the temperature detected by the temperature-detecting unit and the drive value detected by the drive value-detecting unit based on a relationship between the reference luminescence amount and the temperature of the light source and the drive value which are obtained previously; and a deterioration-detecting unit configured to obtain an initial status value based on a ratio of the reference luminescence amount obtained based on the temperature and the drive value in an initial status by the reference luminescence amount-acquiring unit and the luminescence amount in the initial status detected by the luminescence amount-detecting unit, obtain a current status value based on a ratio of the reference luminescence amount obtained based on a current temperature and a current drive value by the reference luminescence amount-acquiring unit and a current luminescence amount detected by the luminescence amount-detecting unit, compare the initial status value with the current status value, and give an instruction to display deterioration of the display device or the light source when calibration is determined to be required.

[3] Further, the present invention provides a performance deterioration-detecting method of a display device configured to include a display panel, a light source configured to illuminate the display panel, and a control unit configured to control a luminescence amount of the light source, including: a luminescence amount-detecting process of detecting a luminescence amount of the light source or the display panel; a drive value-detecting process of detecting a drive value that is used to control the luminescence amount of the light source by the control unit; a temperature-detecting process of detecting an internal temperature or external temperature of the display device; a reference luminescence amount-acquiring process of obtaining a reference luminescence amount corresponding to the temperature detected in the temperature-detecting process and the drive value detected by the drive value-detecting process based on a relationship between the reference luminescence amount and the temperature of the light source and the drive value which are obtained previously; and a deterioration-detecting process of obtaining an initial status value based on a ratio of the reference luminescence amount obtained based on the temperature and the drive value in an initial status in the reference luminescence amount-acquiring process and the luminescence amount in the initial status detected in the luminescence amount-detecting process, obtaining a current status value based on a ratio of the reference luminescence amount obtained based on a current temperature and a current drive value in the reference luminescence amount-acquiring process and a current luminescence amount detected in the luminescence amount-detecting process, comparing the initial status value with the current status value, and giving an instruction to display deterioration of the display device or the light source when calibration is determined to be required.

Effects of the Invention

According to the present invention, it is possible to detect display characteristic deterioration needing calibration regardless of a use status.

EMBODIMENTS FOR CARRYING OUT THE INVENTION

Hereinafter, an exemplary embodiment of the present invention will be described with reference to the appended drawings.

Figure 1:
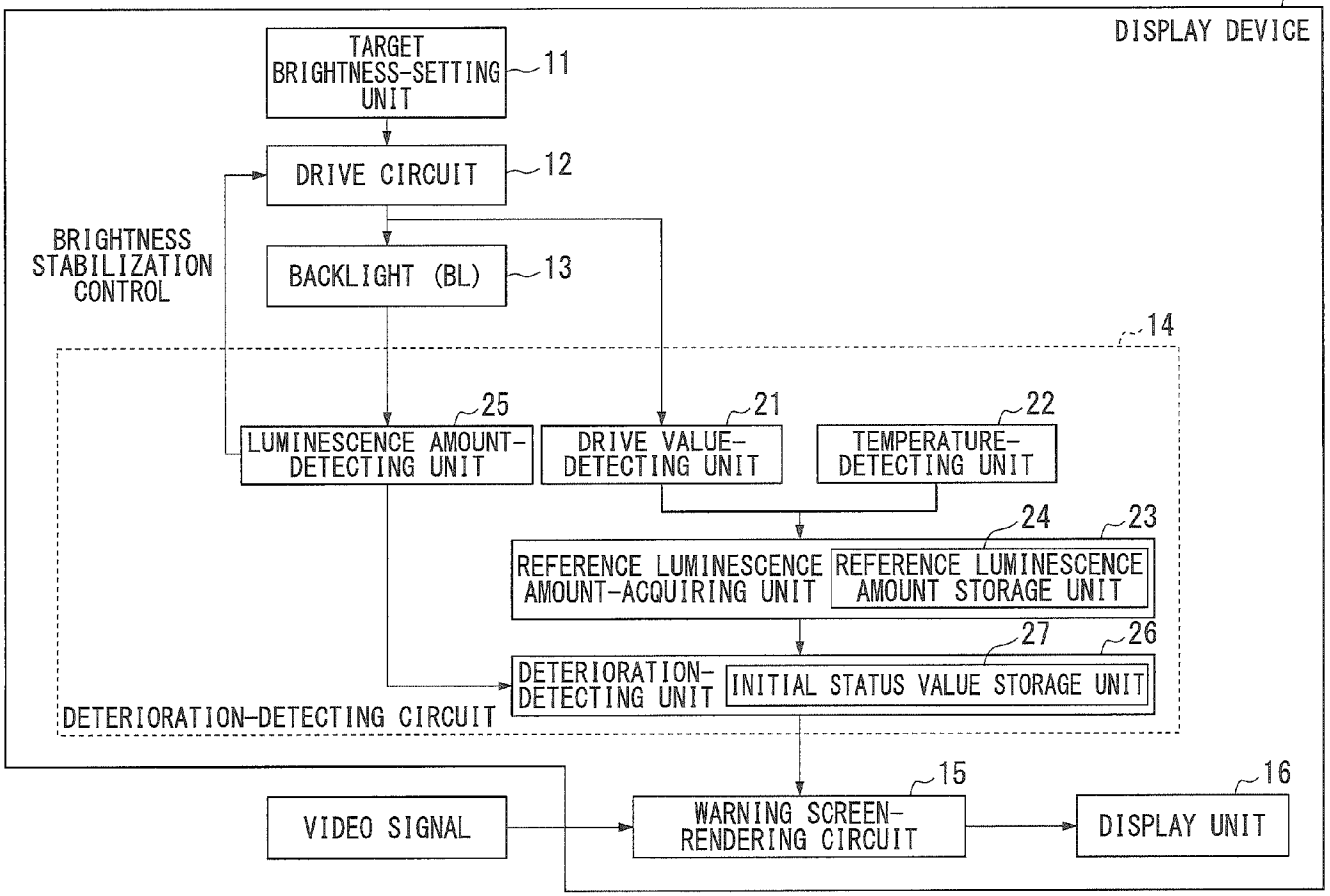
FIG. 1 is a block diagram illustrating a configuration of a display device according to an embodiment of the present invention.

FIG. 1 is a block diagram illustrating a configuration of a display device 1 according to an embodiment of the present invention. The display device 1 includes a target brightness-setting unit 11, a drive circuit 12, a backlight 13 (a "backlight" is hereinafter referred to as a "BL"), a deterioration-detecting circuit 14, a warning screen-rendering circuit 15, and a display unit 16 as illustrated in FIG. 1.

The display unit 16 is a display panel such as an LCD or a micromirror device. The BL 13 is a light source that illuminates the display panel. The target brightness-setting unit 11 sets target brightness of the BL 13 input by, for example, a switch installed in the display device 1 to the drive circuit 12. The drive circuit 12 drives the BL 13 based on a BL drive value corresponding to the target brightness set by the target brightness-setting unit 11. For example, the BL drive value is a control value used to change BL brightness such as a voltage, an electric current, or a pulse width modulation (PWM) duty at the time of BL control.

The deterioration-detecting circuit 14 includes a drive value-detecting unit 21, a temperature-detecting unit 22, a reference luminescence amount-acquiring unit 23, a luminescence amount-detecting unit 25, and a deterioration-detecting unit 26.

The drive value-detecting unit 21 detects the BL drive value used when the drive circuit 12 drives the BL 13. The temperature-detecting unit 22 detects an internal temperature or external temperature of the display device 1.

The reference luminescence amount-acquiring unit 23 includes a reference luminescence amount storage unit 24 that stores data representing a relationship among the BL drive value, the temperature, and a reference luminescence amount. In the present embodiment, reference brightness is used as the reference luminescence amount. The reference brightness is brightness used as a reference for determining a deterioration status of brightness. The reference luminescence amount-acquiring unit 23 obtains the reference brightness corresponding to a combination of the BL drive value detected by the drive value-detecting unit 21 and the temperature detected by the temperature-detecting unit 22 based on the data stored in the reference luminescence amount storage unit 24.

The luminescence amount-detecting unit 25 detects or estimates brightness as the luminescence amount of the BL 13. Further, the luminescence amount-detecting unit 25 performs brightness stabilization control of notifying the drive circuit 12 of a new BL drive value so that brightness can be constant based on a current brightness.

The deterioration-detecting unit 26 calculates a status value representing a status of a display characteristic by comparing the reference brightness calculated by the reference luminescence amount-acquiring unit 23 with the brightness detected by the luminescence amount-detecting unit 25. The deterioration-detecting unit 26 compares a status value of an initial status with a current status value, and notifies the warning screen-rendering circuit 15 of performance deterioration when a deterioration status needing calibration is detected. The deterioration-detecting unit 26 includes an initial status value storage unit 27 that stores an initial value of a deterioration status.

When a notification of performance deterioration is not given from the deterioration-detecting unit 26, the warning screen-rendering circuit 15 causes a screen of a video signal input from a personal computer, a video, or the like to be displayed on the display unit 16 without change. When a notification of performance deterioration is given from the deterioration-detecting unit 26, the warning screen-rendering circuit 15 causes a warning screen superimposed on the screen of the video signal to be displayed on the display unit 16.

The target brightness-setting unit 11, the drive circuit 12, the BL 13, the warning screen-rendering circuit 15, and the display unit 16 are implemented by an existing common technique.

In the present embodiment, in order to avoid harming the aesthetics of a display screen, for example, to prevent a display screen from being partially concealed, a method of detecting brightness of the BL 13 at the side or back of the display panel (the display unit 16) is employed. However, the same effect is obtained even when screen brightness is detected by the luminescence amount-detecting unit 25 installed on the display screen of the display panel (the display unit 16).

Further, in the present embodiment, brightness is used as the luminescence amount, but a measure of the luminescence amount can be appropriately selected according to a luminescence amount-detecting means equipped in the luminescence amount-detecting unit 25. For example, RGB (red, green, and blue) values of a color sensor or a luminance sensor value may be used instead of brightness.

Next, an operation of the display device 1 will be described.

A manufacturer of the display device 1 measures a brightness characteristic using the display device 1 in advance when the BL drive value and the temperature are changed. This is because the BL 13 has a characteristic in which brightness significantly changes depending on the BL drive value and the temperature.

Figure 2:
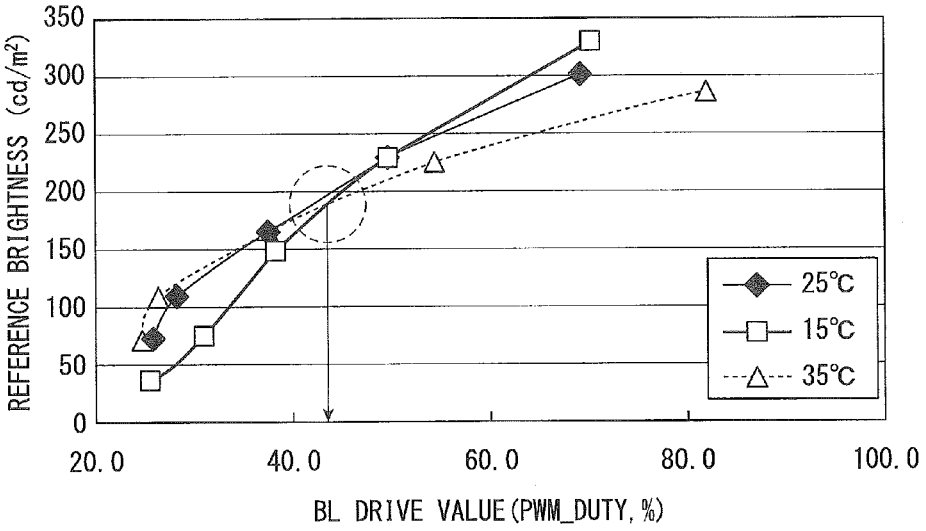
FIG. 2 is a diagram illustrating a brightness characteristic corresponding to a change in an ambient temperature and a BL drive value.

FIG. 2 is a diagram illustrating a brightness characteristic corresponding to a change in the ambient temperature and the BL drive value. FIG. 2 illustrates an example in which a PWM duty is used as the BL drive value. FIG. 2 illustrates a relationship between the BL drive value and the reference brightness that is brightness when the drive circuit 12 drives the BL 13 based on the BL drive value for each ambient temperature of 15° C., 25° C., and 35° C.

Figure 3:
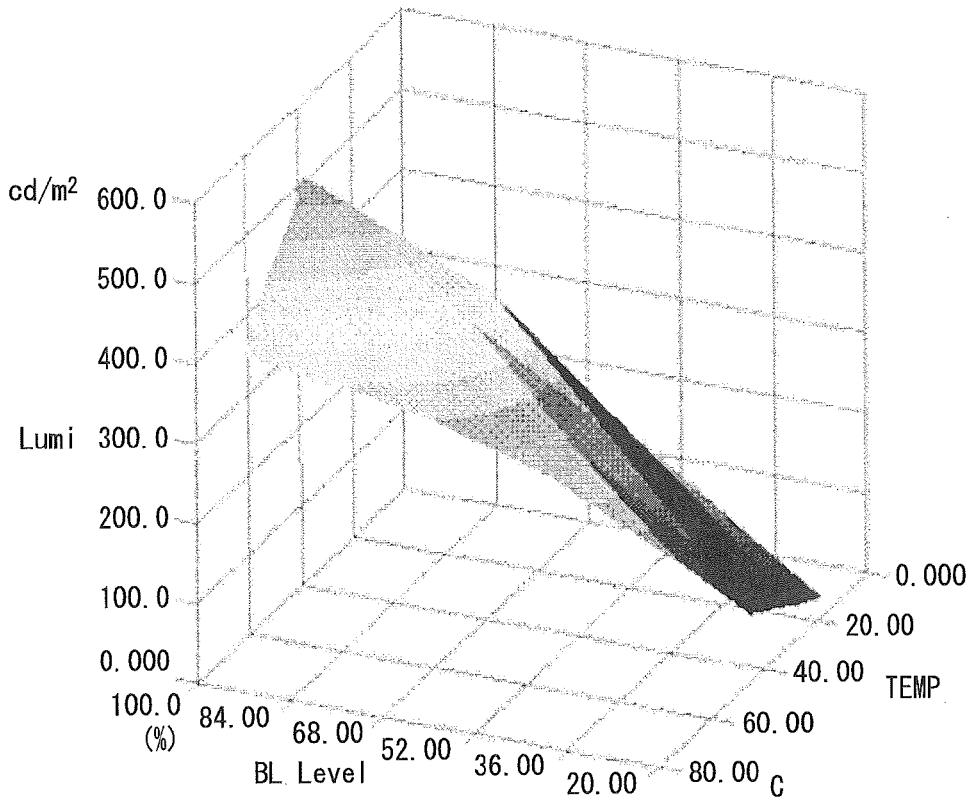
FIG. 3 is a diagram illustrating a two-dimensional (2D) look-up table.
Figure 4:
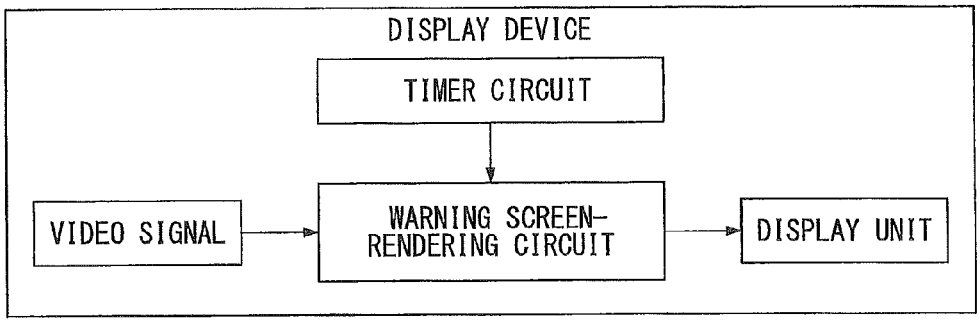
FIG. 4 is a block diagram illustrating a configuration of a display device according to a related art.

FIG. 3 is a diagram illustrating a 2D look-up table (hereinafter referred to as a "2DLUT") generated from the relationship among the temperature, the BL drive value, and the reference brightness illustrated in FIG. 2. The 2DLUT is data representing a correspondence between a set of the temperature (TEMP) and the BL drive value (BL Level) and the reference brightness (Lumi) as illustrated in FIG. 3. The manufacturer of the display device 1 generates the 2DLUT illustrated in FIG. 3 based on the brightness characteristic obtained as in FIG. 2. The generated 2DLUT is stored in the reference luminescence amount storage unit 24 of the display device 1.

Then, initial characteristics of the display device 1 are stored at a point in time directly after calibration, for example, when produced in a factory. The point in time directly after calibration is referred to as a "time of initial characteristic setting."

First, the drive value-detecting unit 21 of the display device 1 reads the BL drive value at the time of initial characteristic setting from the drive circuit 12, and outputs the read BL drive value to the reference luminescence amount-acquiring unit 23. At the same time, the temperature-detecting unit 22 reads the temperature at the time of initial characteristic setting, and outputs the read temperature to the reference luminescence amount-acquiring unit 23.

The reference luminescence amount-acquiring unit 23 reads the reference brightness from the 2DLUT (FIG. 3) stored in the reference luminescence amount storage unit 24 in advance using the received temperature and the BL drive value as search conditions. The reference luminescence amount-acquiring unit 23 outputs the read reference brightness to the deterioration-detecting unit 26.

The deterioration-detecting unit 26 acquires the brightness of the BL 13 at the time of initial characteristic setting from the luminescence amount-detecting unit 25. The deterioration-detecting unit 26 calculates a ratio of the reference brightness obtained from the 2DLUT by the reference luminescence amount-acquiring unit 23 using the temperature and the drive value at the time of initial characteristic setting and the brightness at the time of initial characteristic setting received from the luminescence amount-detecting unit 25. The deterioration-detecting unit 26 writes the calculated ratio in the initial status value storage unit 27 as the initial status value (InitStatus).

Next, a performance deterioration detection process performed under the assumption that the display device 1 was shipped and is being used by the user will be described. For example, the performance deterioration detection process is periodically performed at certain time intervals.

First, the drive value-detecting unit 21 of the display device 1 reads the current BL drive value from the drive circuit 12, and outputs the current BL drive value to the reference luminescence amount-acquiring unit 23. At the same time, the temperature-detecting unit 22 reads the current temperature, and outputs the current temperature to the reference luminescence amount-acquiring unit 23.

The reference luminescence amount-acquiring unit 23 reads the reference brightness from the 2DLUT (FIG. 3) stored in the reference luminescence amount storage unit 24 in advance using the received temperature and the BL drive value as the search conditions. The reference luminescence amount-acquiring unit 23 outputs the read reference brightness to the deterioration-detecting unit 26.

The deterioration-detecting unit 26 acquires the current brightness of the BL 13 from the luminescence amount-detecting unit 25. The deterioration-detecting unit 26 calculates a current status value (CurrentStatus) that is a ratio of the reference brightness obtained from the 2DLUT by the reference luminescence amount-acquiring unit 23 using the current temperature and the BL drive value and the current brightness received from the luminescence amount-detecting unit 25.

Then, the deterioration-detecting unit 26 divides the calculated current status value by the initial status value read from the initial status value storage unit 27, and calculates a performance retention rate (PerformanceRatio) as in Formula (1):

$$\text{Performance retention rate [\%]} = \text{current status value} / \text{initial status value} \quad (1)$$

The performance retention rate is a deterioration detection value that becomes 100% directly after calibration and serves as an index that decreases as deterioration of the display device 1 progresses. The deterioration-detecting unit 26 determines that calibration is required when the calculated performance retention rate is lower than a predetermined permissible limit (threshold value), and outputs the warning output instruction to the warning screen-rendering circuit 15. The warning screen-rendering circuit 15 notifies of performance deterioration of a display characteristic, and causes a warning screen warning that calibration is required to be displayed on the display unit 16.

As described above, the display device 1 displays the warning screen on the display unit 16, and urges the user to calibrate the display device 1. For example, when the permissible limit is 90%, the warning screen is displayed when the display device 1 is used for about 1000 to 2000 hours after calibration.

In the above embodiment, the performance retention rate of the display device 1 is detected based on a change in luminance efficiency of the BL 13. Thus, the display device 1 can suggest calibration only when certain performance deterioration is detected. Thus, compared to the display device of the related art assuming the state in which the performance deterioration progresses rapidly, it is possible to reliably maintain the performance while reducing the calibration frequency.

At this time, the present embodiment has advantages in that the performance retention rate can be detected even when the brightness stabilization control is performed, and the performance retention rate is constant even when the ambient temperature or the display brightness changes at the time of measurement. For example, the performance retention rate becomes 100% directly after calibration regardless of a brightness setting, and thus the performance retention rate can be accurately detected even at a brightness different from that at the time of calibration.

As described above, in the present embodiment, in a display device including a display panel (display unit) such as an LCD or a micromirror device, a light source (BL) that illuminates a display panel, and a control unit (drive circuit) that controls a luminescence amount of the light source, a drive value-detecting unit detects a drive value (a BL drive value) used to control a luminescence amount of the light source of its own display device by the control unit, and a temperature-detecting unit detects an internal temperature or external temperature of the display device. A luminescence amount-detecting unit detects or estimates a luminescence amount (brightness) of the light source or the display panel. A reference luminescence amount-acquiring unit obtains a reference luminescence amount (reference brightness) of the light source corresponding to the drive value detected by the drive value-detecting unit and the temperature detected by the temperature-detecting unit. A deterioration-detecting unit calculates an initial status value based on a ratio of the reference luminescence amount obtained based on a temperature and a drive value in an initial status by the reference luminescence amount-acquiring unit and a luminescence amount in the initial status detected by the luminescence amount-detecting unit, and stores the initial status value. The deterioration-detecting unit further calculates a current status value based on a ratio of a reference luminescence amount obtained based on a current temperature and drive value by the reference luminescence amount-acquiring unit and a current luminescence amount detected by the luminescence amount-detecting unit, compares the stored initial status value with the calculated current status value, and determines whether calibration is required. A warning screen display unit causes deterioration of the display device or the light source to be displayed on the display panel based on the determination. Through this operation, the display device reports performance deterioration of a display characteristic to the user.

In the above embodiment, the reference luminescence amount-acquiring unit 23 uses the 2DLUT illustrated in FIG. 3 in order to obtain the reference brightness, but may calculate the reference brightness using a certain calculation formula. The calculation formula is a formula for calculating the reference brightness based on the temperature and the BL drive value using a polynomial expansion that approximates the characteristics represented by the 2DLUT.

Further, the reference brightness output by the reference luminescence amount-acquiring unit 23 may be absolute brightness, a proportion of certain brightness used as a reference, or relative brightness. In this case, the 2DLUT is data representing a correspondence between a set of the temperature and the BL drive value and the relative brightness. Alternatively, the reference luminescence amount-acquiring unit 23 calculates the relative brightness based on the temperature and the BL drive value using a polynomial expansion that approximates the characteristics represented by the 2DLUT.

Further, the reference brightness preferably has a drive level that is small in a brightness change even when the temperature changes. For example, in FIG. 2, a circular portion indicated by a dotted line is small in a brightness change caused by the temperature. In this regard, the brightness of the BL 13 when the drive circuit 12 is driven based on the BL drive value indicated by the circular portion is used as the reference brightness.

Further, when the relative brightness is used, it is desirable to perform normalization at a drive level that is small in brightness change even when the temperature changes. For example, in FIG. 2, the circular portion indicated by the dotted line is small in a brightness change caused by the temperature. In this regard, the brightness of the BL 13 when the drive circuit 12 is driven based on the BL drive value indicated by the circular portion is used as the relative brightness.

Further, in the above embodiment, the performance deterioration is reported to the user, but conversely, a normal status may be reported at a normal time.

Further, in the above embodiment, the reference luminescence amount-acquiring unit 23 obtains the reference brightness corresponding to the detected temperature and the BL drive value, and the deterioration-detecting unit 26 compares the reference brightness with the brightness of the BL detected when the temperature and the BL drive value are detected. However, the same effects are obtained even when, conversely, the reference brightness is fixed, and the current brightness is corrected to correspond to the temperature and the BL drive value at the reference brightness.

The display device according to the present embodiment has the following advantages.

(1) It is possible to detect deterioration of a display characteristic of a display device even under a condition in which brightness is constant due to performance of brightness stabilization.

(2) A deterioration status value changes according to a deterioration status of an actual display characteristic of a display device. In other words, since deterioration progresses rapidly at high brightness or high ambient temperature even when an operating time is the same, the deterioration status value significantly changes.

(3) A deterioration detection value (a threshold value of a deterioration status value) used to determine that calibration is required is constant without depending on an ambient temperature or display brightness at the time of detection.

(4) The present invention can be applied to various display devices such as projectors or LCDs. One of an extra-high pressure mercury lamp, a W/RGB light emitting diode (LED), and a cold cathode fluorescent lamp (CCFL) can be selected as the backlight. The luminescence amount-detecting unit 25 may detect screen brightness or may detect backlight brightness at the side or back of the screen. The luminescence amount detected by the luminescence amount-detecting unit 25 may be replaced with another measure representing a luminescence amount such as an RGB value of a color sensor or a luminance value instead of brightness. For example, in a display device having a multi-color backlight, an RGB value of a color sensor is appropriate.

Due to the above advantages, it is possible to reduce the calibration frequency of the display device when the display device is used in an environment in which performance degradation is slow while maintaining the same usability as in the timer technique of the related art.

The display device according to the present embodiment is appropriate for display devices used in industries in which high-accuracy color reproduction is required such as displays for graphic design use or displays for medical use.

Particularly, in displays for medical use, it is necessary to detect display characteristic deterioration with a high degree of accuracy, and it is effective when used in a state in which it is not acceptable to recalibrate a display characteristic without confirmation of an administrator (automatically) for reasons such as quality management.

The exemplary embodiment of the present invention has been described above, but the deterioration-detecting circuit 14 illustrated in FIG. 1 is implemented by dedicated hardware (for example, a wired logic or the like). Further, a part of the deterioration-detecting circuit 14 may be configured with a memory and a central processing unit (CPU), and the respective functions thereof may be implemented by loading a program for implementing the respective functions from the memory and executing the program.

Further, the program may be transmitted from a computer system in which the program is stored in a storage device or the like to another computer system via a transmission medium or a transmission wave in a transmission medium. Here, the "transmission medium" for transmitting the program is a medium having a function of transmitting information such as a network (communication network) such as the Internet or a communication line such as a telephone line. Further, the program may be one which implements part of the above-described function. Further, the program may be one which implements the above-described function in combination with a program stored in a computer in advance or a differential file (differential program).

DESCRIPTION OF REFERENCE SYMBOLS

1 display device
11 target brightness-setting unit
12 drive circuit
13 BL
14 deterioration-detecting circuit
15 warning screen-rendering circuit
16 display unit
21 drive value-detecting unit
22 temperature-detecting unit
23 reference luminescence amount-acquiring unit
24 reference luminescence amount storage unit
25 luminescence amount-detecting unit
26 deterioration-detecting unit
27 initial status value storage unit

The invention claimed is:

1. A deterioration-detecting circuit of a display device including a display panel, a light source that illuminates the display panel, and a control unit that controls a luminescence amount of the light source, comprising:

a luminescence amount-detecting unit configured to detect a luminescence amount of the light source or the display panel;

a drive value-detecting unit configured to detect a drive value that is used to control the luminescence amount of the light source by the control unit;

a temperature-detecting unit configured to detect an internal temperature or external temperature of the display device;

a reference luminescence amount-acquiring unit configured to obtain a reference luminescence amount corresponding to the temperature detected by the temperature-detecting unit and the drive value detected by the drive value-detecting unit based on a relationship between the reference luminescence amount and the temperature of the light source and the drive value which are obtained previously; and a deterioration-detecting unit configured to obtain an initial status value based on a ratio of the reference luminescence amount obtained based on the temperature and the drive value in an initial status by the reference luminescence amount-acquiring unit and the luminescence amount in the initial status detected by the luminescence amount-detecting unit, obtain a current status value based on a ratio of the reference luminescence amount obtained based on a current temperature and a current drive value by the reference luminescence amount-acquiring unit and a current luminescence amount detected by the luminescence amount-detecting unit, compare the initial status value with the current status value, and give an instruction to display deterioration of the display device or the light source when calibration is determined to be required.

2. The deterioration-detecting circuit according to claim 1, wherein the deterioration-detecting unit calculates a performance retention rate based on a ratio of the initial status value and the current status value, and determines whether calibration is required according to whether or not the calculated performance retention rate exceeds a threshold value.

3. A display device, comprising:

a display panel;

a light source configured to illuminate the display panel;

a control unit configured to control a luminescence amount of the light source;

a luminescence amount-detecting unit configured to detect a luminescence amount of the light source or the display panel;

a drive value-detecting unit configured to detect a drive value that is used to control the luminescence amount of the light source by the control unit;

a temperature-detecting unit configured to detect an internal temperature or external temperature of the display device;

a reference luminescence amount-acquiring unit configured to obtain a reference luminescence amount corresponding to the temperature detected by the temperature-detecting unit and the drive value detected by the drive value-detecting unit based on a relationship between the reference luminescence amount and the temperature of the light source and the drive value which are obtained previously; and a deterioration-detecting unit configured to obtain an initial status value based on a ratio of the reference luminescence amount obtained based on the temperature and the drive value in an initial status by the reference luminescence amount-acquiring unit and the luminescence amount in the initial status detected by the luminescence amount-detecting unit, obtain a current status value based on a ratio of the reference luminescence amount obtained based on a current temperature and a current drive value by the reference luminescence amount-acquiring unit and a current luminescence amount detected by the luminescence amount-detecting unit, compare the initial status value with the current status value, and give an instruction to display deterioration of the display device or the light source when calibration is determined to be required.

4. A performance deterioration-detecting method of a display device including a display panel, a light source configured to illuminate the display panel, and a control unit configured to control a luminescence amount of the light source, comprising:

a luminescence amount-detecting process of detecting a luminescence amount of the light source or the display panel;

a drive value-detecting process of detecting a drive value that is used to control the luminescence amount of the light source by the control unit;

a temperature-detecting process of detecting an internal temperature or external temperature of the display device;

a reference luminescence amount-acquiring process of obtaining a reference luminescence amount corresponding to the temperature detected in the temperature-detecting process and the drive value detected by the drive value-detecting process based on a relationship between the reference luminescence amount and the temperature of the light source and the drive value which are obtained previously; and a deterioration-detecting process of obtaining an initial status value based on a ratio of the reference luminescence amount obtained based on the temperature and the drive value in an initial status in the reference luminescence amount-acquiring process and the luminescence amount in the initial status detected in the luminescence amount-detecting process, obtaining a current status value based on a ratio of the reference luminescence amount obtained based on a current temperature and a current drive value in the reference luminescence amount-acquiring process and a current luminescence amount detected in the luminescence amount-detecting process, comparing the initial status value with the current status value, and giving an instruction to display deterioration of the display device or the light source when calibration is determined to be required.

* * * * *